US005626271A

United States Patent [19]

Messey et al.

[11] Patent Number: 5,626,271

[45] Date of Patent: May 6, 1997

[54] CHILD CARRIER WITH KICKSTAND

[75] Inventors: Christopher J. Messey, St. Louis, Mo.; Timothy O'Shea; Terry Ellard, both of Seattle, Wash.

[73] Assignee: American Recreation Products, Inc., St. Louis, Mo.

[21] Appl. No.: 514,186

[22] Filed: Aug. 11, 1995

[51] Int. Cl.[6] ..... A61G 1/00

[52] U.S. Cl. ..... 224/161; 224/158; 280/30; 297/129

[58] Field of Search ..... 224/158, 159, 224/160, 161, 153, 576, 584; 280/30, 642, 643, 644; 297/129

[56] References Cited

U.S. PATENT DOCUMENTS

| | | | |
|---|---|---|---|
| 3,194,577 | 7/1965 | Berlin | 280/643 |
| 3,989,173 | 11/1976 | Gebhard | 224/161 |
| 4,044,931 | 8/1977 | Catelli | 224/161 |
| 4,157,837 | 6/1979 | Kao | 280/30 |
| 4,300,707 | 11/1981 | Kjaer | 297/129 |
| 4,324,430 | 4/1982 | Dimas, Jr. et al. | 224/159 |
| 4,586,721 | 5/1986 | Harada et al. | 280/30 |
| 4,676,466 | 6/1987 | Nakao et al. | 224/160 |
| 4,676,548 | 6/1987 | Bradbury | 297/129 |
| 4,746,044 | 5/1988 | Arvizu et al. | 224/161 |
| 4,747,526 | 5/1988 | Launes | 224/161 |
| 4,762,256 | 8/1988 | Whitaker | 280/161 |
| 4,923,104 | 5/1990 | Rice et al. | 224/160 |
| 4,938,400 | 7/1990 | Springston | 224/161 |

FOREIGN PATENT DOCUMENTS

| | | | |
|---|---|---|---|
| 091075006B | 10/1992 | Australia | 224/161 |
| 1401240 | 7/1975 | United Kingdom | 224/161 |

OTHER PUBLICATIONS

Photographs of child carrier with kickstand, admitted prior art.

*Primary Examiner*—Henry J. Recla
*Assistant Examiner*—Gregory M. Vidovich
*Attorney, Agent, or Firm*—Senniger, Powers, Leavitt & Roedel

[57] ABSTRACT

A child carrier for supporting a child adjacent the back of a hiker's torso comprises a forward portion and a rearward portion. A child compartment is between the forward and rearward portions for receiving a child. A generally rigid frame member is operatively connected to and adjacent the rearward portion of the child carrier. A kickstand having a ground-engageable portion is operatively connected to the frame member via a hinge for pivotal movement of the kickstand relative to the frame member about an axis X. The kickstand is pivotally moveable between a retracted position in which the ground-engageable portion of the kickstand is positioned generally adjacent the frame member, and a propping position in which the ground-engageable portion of the kickstand is positioned away from the frame member. The kickstand, hinge, and frame member are shaped and configured for maintaining at least a minimum spacing between the kickstand and frame member for preventing hands and fingers of the child seated within the child compartment from being pinched between the kickstand and frame member during pivotal movement of the kickstand relative to the frame member.

10 Claims, 7 Drawing Sheets

102
44
136
134
134
82
84
80
130
132
142

CHILD CARRIER WITH KICKSTAND

BACKGROUND OF THE INVENTION

This invention relates generally to child carriers for supporting children adjacent the backs of hikers, and more particularly to a child carrier having a kickstand for supporting the child carrier generally upright.

A conventional child carrier has a forward portion with shoulder straps and a waist strap (belt) for holding the child carrier on the back of a hiker. A child compartment for holding a child is generally rearward of the forward portion. Some child carriers have a frame member and a kickstand pivotally connected thereto via hinges, the kickstand being moveable between a retracted position in which the kickstand is positioned forward adjacent the frame member, and a propping position in which a ground engageable portion of the kickstand is positioned away from the frame member for engaging a generally horizontal surface (e.g., a floor or ground) to prop the child carrier generally upright when the child carrier is not being worn.

In order to properly support the child carrier, the kickstand and hinges are generally within reach of a child seated in the child compartment. Because of the configuration of conventional kickstands and hinges, the child's hands and fingers may be pinched between the kickstand and frame member or by the hinge when the kickstand is moved between its retracted and propping positions. Another disadvantage of such a carrier is that hikers often forget to pivot the kickstand to its retracted position. Because of this, a hiker wearing the child carrier may inadvertently bump (knock) into something or someone with the extended kickstand. A child standing near the hiker may be especially susceptible to injury because his or her head may be at about the level of the extended kickstand.

SUMMARY OF THE INVENTION

Among the several objects and features of this invention may be noted the provision of an improved child carrier with a pivotable kickstand; the provision of such a child carrier which is designed to avoid pinching of a child's fingers and hands when the kickstand is pivoted; and the provision of such a child carrier in which the kickstand automatically moves to its retracted position when the child carrier is donned by a hiker.

Generally, a child carrier of the present invention for supporting a child adjacent the back of a hiker's torso comprises a forward portion, a rearward portion, and a seat portion. The forward portion has straps engageable with the hiker's torso for enabling the hiker to tote the child carrier in a hands-free manner. The rearward portion is generally rearward of and spaced from the forward portion. The seat portion is generally between the forward and rearward portions and operatively connected thereto for supporting a child. A child compartment is between the forward and rearward portions and defined at least in part by the seat portion. A generally rigid frame member is operatively connected to and adjacent the rearward portion of the child carrier. A kickstand having a ground-engageable portion is operatively connected to the frame member via a hinge for pivotal movement of the kickstand relative to the frame member about an axis X (FIG. 1). The kickstand is pivotally moveable between a retracted position in which the ground-engageable portion of the kickstand is positioned generally adjacent the frame member, and a propping position in which the ground-engageable portion of the kickstand is positioned away from the frame member for engaging a generally horizontal surface to prop the child carrier in a generally upright position on the surface when the child carrier is not being worn by the hiker. The kickstand, hinge, and frame member are shaped and configured for maintaining at least a minimum spacing between all portions of the kickstand and frame member which are within reach of a child seated in the child compartment and having arms ten inches in length. The minimum spacing is sufficient for preventing hands and fingers of the child seated within the child compartment from being pinched between the kickstand and frame member during pivotal movement of the kickstand relative to the frame member.

In another aspect of the present invention, a child carrier includes a generally rigid frame member operatively connected to and adjacent the rearward portion of the child carrier, a kickstand having a ground-engageable portion and an end portion, and a hinge. The hinge comprises a generally rigid block fixed to the frame member. The rigid block defines a socket. The end portion of the kickstand is received within the socket and is pivotally connected to the rigid block for pivotal movement of the kickstand relative to the frame member between a retracted position in which the ground-engageable portion of the kickstand is positioned generally adjacent the frame member, and a propping position in which the ground-engageable portion of the kickstand is positioned away from the frame member for engaging a generally horizontal surface to prop the child carrier in a generally upright position on the surface when the child carrier is not being worn by the hiker. The rigid block has a shoulder within the socket engageable by the end portion of the kickstand when the kickstand is in its retracted position. The shoulder acts as a stop when the kickstand is pivoted from its propping position to its retracted position for preventing pivoting of the kickstand to a position in which it engages the frame member.

In another aspect of the present invention a child carrier includes a kickstand having a ground-engageable portion. At least one of the operational straps of the forward portion of the carrier is operatively connected to the kickstand so that tensioning of the strap(s) causes the kickstand to move to its retracted position.

In yet another aspect of the present invention a child carrier includes a kickstand having a ground-engageable portion and at least one resilient member applying a biasing force to the kickstand for urging the kickstand to its propping position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
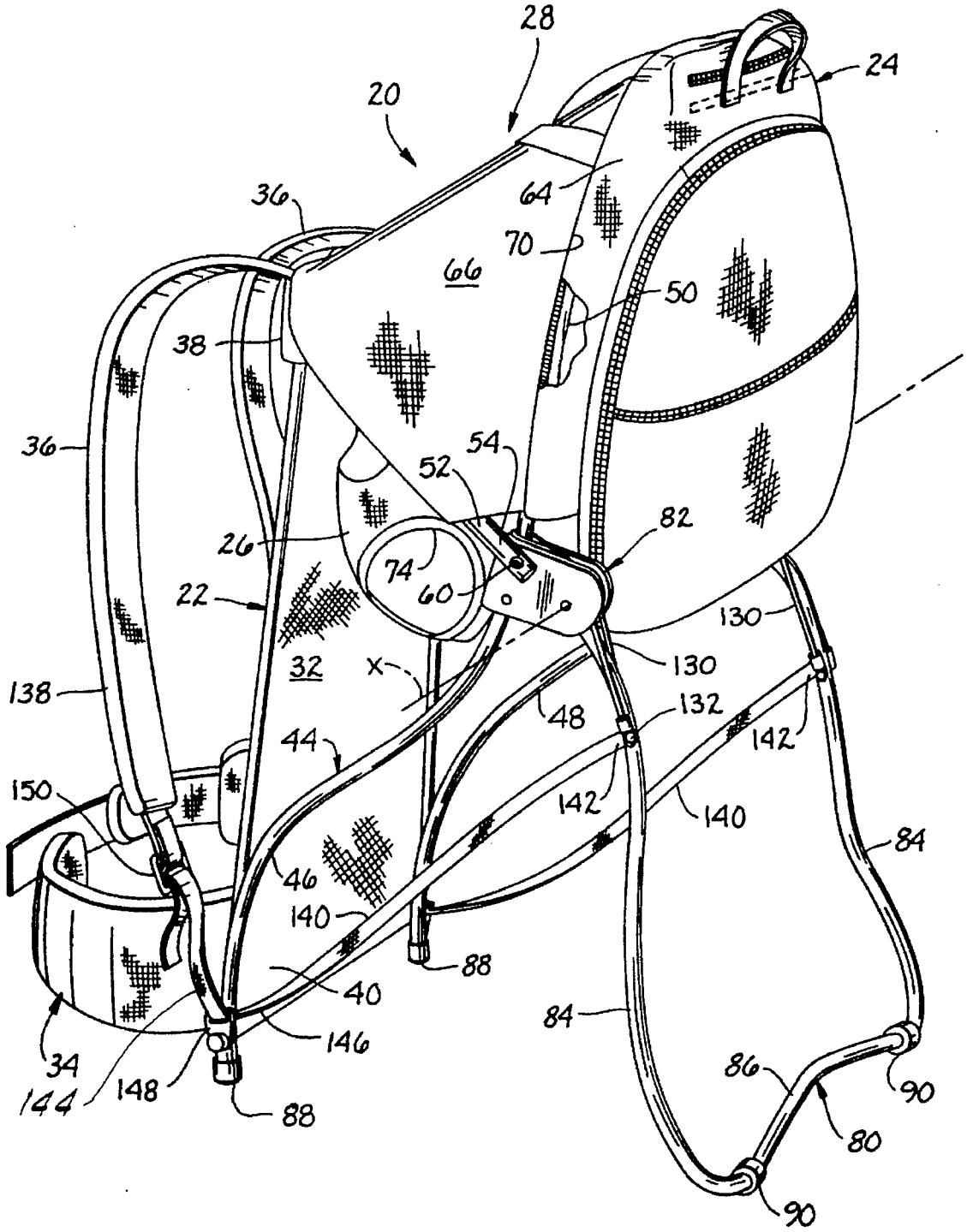
FIG. 1 is a perspective view of a child carrier of this invention.
Figure 2:
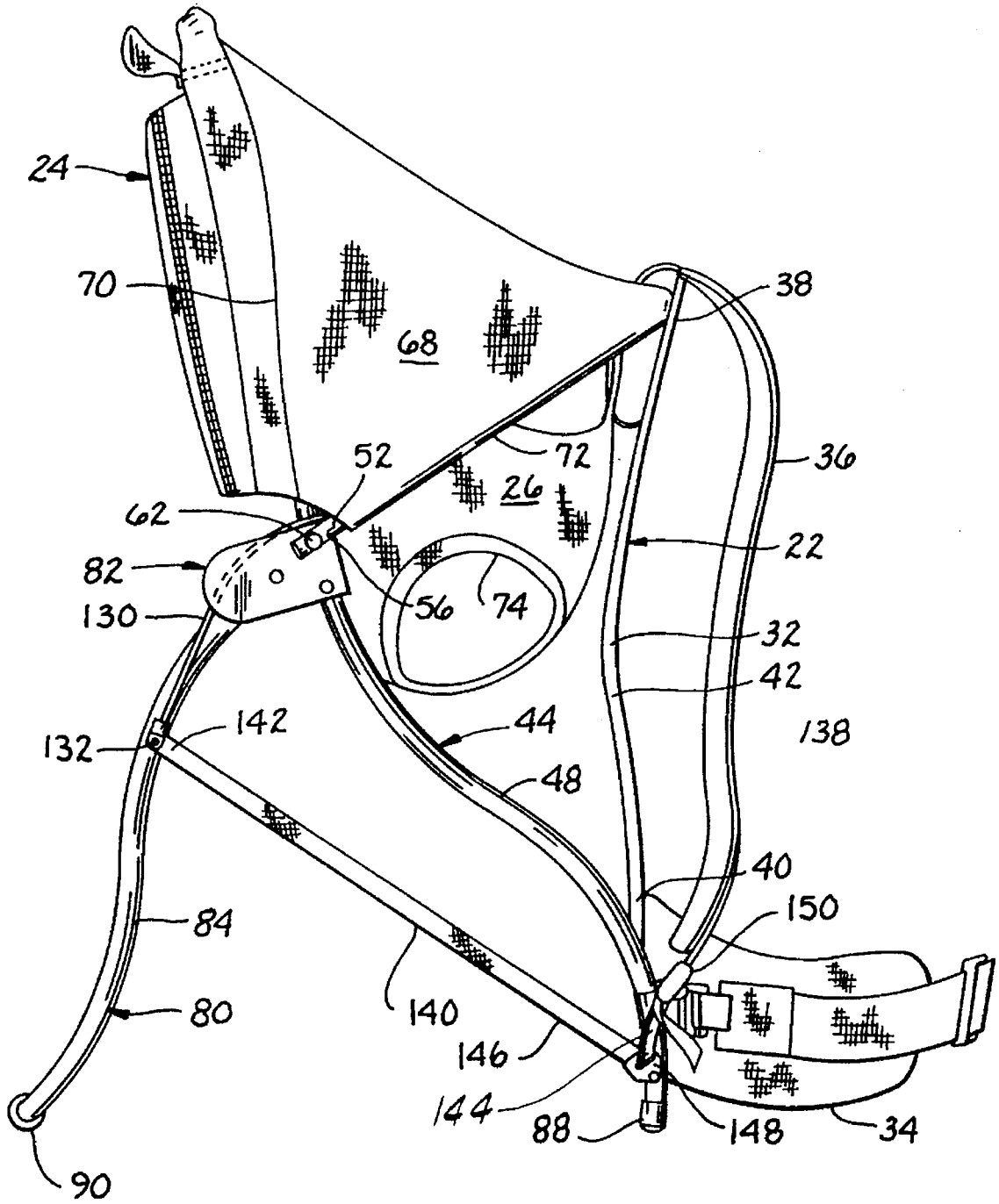
FIG. 2 is a side elevational view of the child carrier of FIG. 1 with a kickstand of the child carrier pivoted to a propping position.
Figure 3:
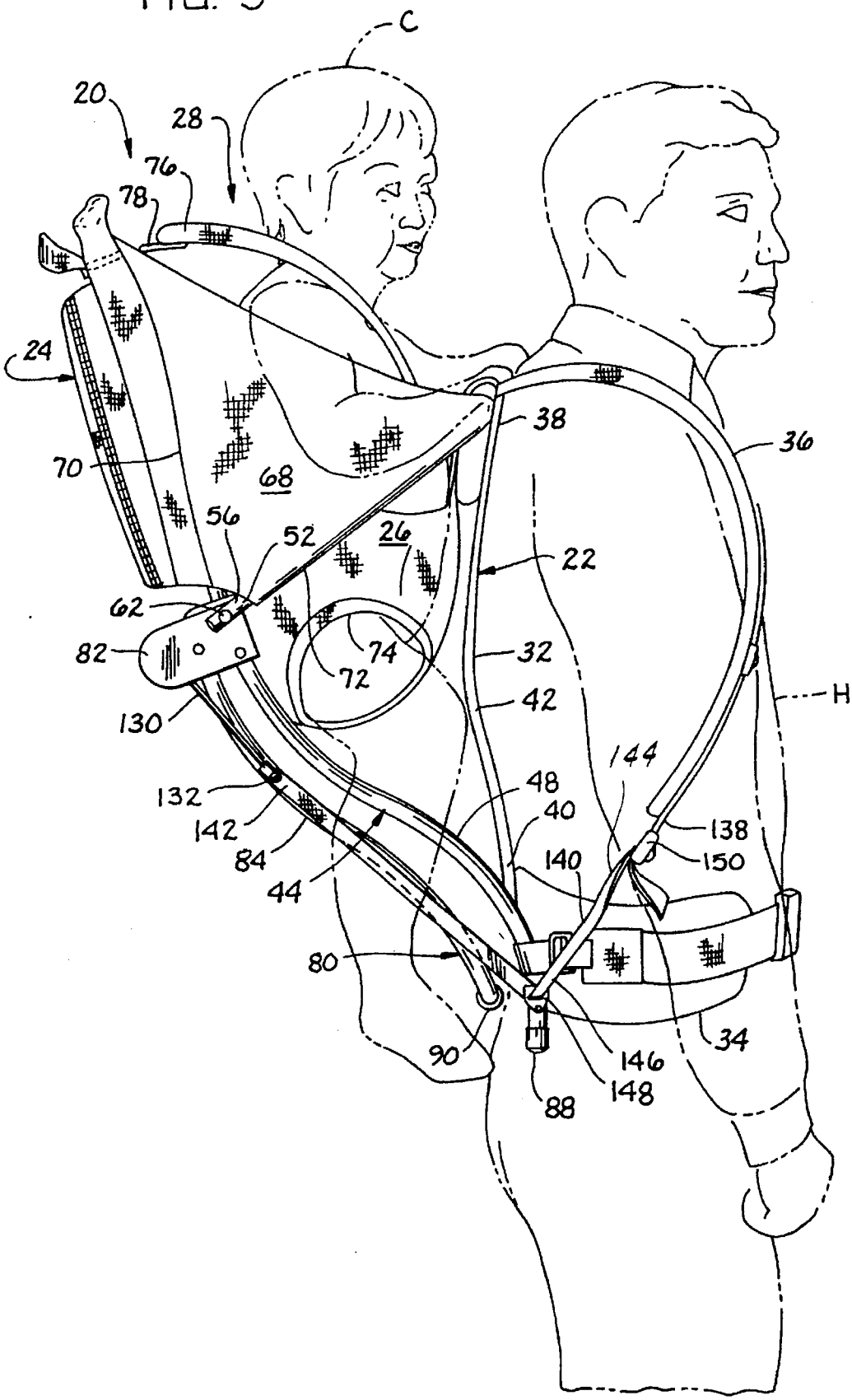
FIG. 3 is a side elevational view of the child carrier of FIGS. 1 and 2 with the kickstand pivoted to a retracted position and with a hiker and child shown in phantom.
Figure 4:
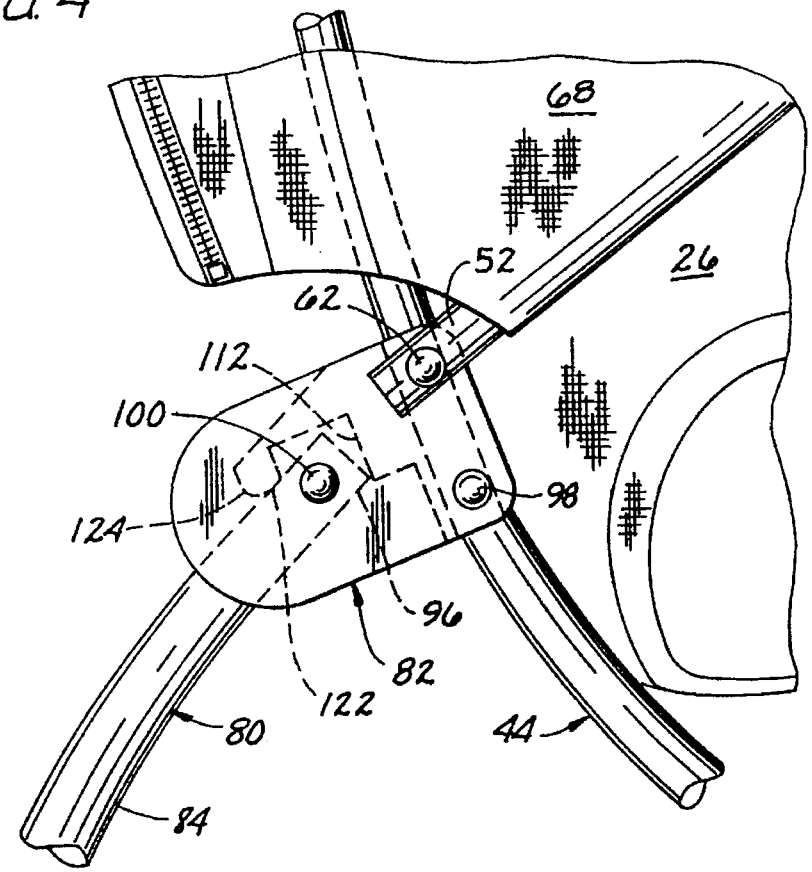
FIG. 4 is an enlarged fragmented side elevational view of the kickstand, hinge, and main frame member of the child carrier of FIGS. 1–3 with the kickstand in its propping position.

Referring now to the drawings, and first more particularly to FIGS. 1–3, a child carrier is indicated in its entirety by the reference numeral 20. The child carrier 20 is adapted for supporting a child C (FIG. 3) adjacent the back of a hiker H. It comprises a forward portion, generally indicated at 22, a rearward portion, generally indicated at 24, a child seat portion 26, and a child compartment, generally indicated at 28, between the forward and rearward portions.

The forward portion 22 comprises a forward member 32, an adjustable waist strap (belt) generally indicated at 34, and adjustable shoulder straps indicated at 36. The forward member 32 is preferably formed of multiple sheets of flexible material joined together as by stitching and is adapted for conforming to and abutting the back of the hiker's torso. It includes an upper region 38 engageable with the upper back of a hiker H wearing the child carrier 20, a lower region 40 adjacent the lower back of the hiker, and an intermediate region extending between the upper and lower regions. The waist strap 34 is attached to the lower region 40 of the forward member 32 for engaging the waist of the hiker H. The shoulder straps 36 are secured to the upper region 38 of the forward member 32 for engaging the shoulders of the hiker H. Preferably, the intermediate region 42 of the forward member 32 comprises a nylon mesh material for permitting the back of the hiker H to breath. As shown in FIG. 3, the waist strap 34 and shoulder straps 36 enable the hiker H to tote the child carrier 20 in a hands-free manner.

A main frame member, generally designated 44, having an inverted-U shape, comprises left and right leg portions 46, 48 and a curved central portion 50 (FIG. 1) adjacent a rear of the child compartment 28. The left and right leg portions 46, 48 are connected adjacent their lower ends to the waist belt 34 and extend upward and rearward (i.e., to the left as viewed in FIG. 2) to the central portion 50 of the main frame member 44. A U-shaped bracket 52, having left and right side portions 54, 56 and a generally horizontal intermediate portion (not shown), connects the main frame member 44 to the upper region 40 of the forward member 32. The left and right side portions 54, 56 of the bracket 52 are pivotally connected to upper regions of the leg portions 46, 48 of the main frame member 44 via pin-connections 60, 62 and extend upward and forward therefrom along sides of the child compartment 28. The intermediate portion of the bracket 52 extends laterally through and is secured to the upper region 38 of the forward member 32. Preferably, the main frame member 44 and bracket 52 are formed of a durable, lightweight tubing such as aluminum.

A flexible, back-support pouch 64, having an open bottom, is positioned over the curved central portion 50 of the main frame member 44. The curved central portion 50 of the main frame member 44 maintains the back-support pouch 64 in a taut configuration for supporting the back of the child C seated in the child compartment 28. The back-support pouch 64 and the curved central portion 50 of the main frame member 44 comprise the rearward portion 24 of the child carrier 20. Left and right side panels 66, 68 of generally triangular-shape have rear edge margins 70 attached to opposite sides of the back-support pouch 64, and bottom edge margins 72 attached to the side portions 54, 56 of the bracket 52. The back-support pouch 64 and bracket 52 hold the side panels 66, 68 taut. The child seat portion 26 is attached to and depends from a bottom edge margin (not shown) of the back support pouch 64 and the bottom edge margins 72 of the side panels 66, 68. The child seat portion 26 has leg holes 74 for passage therethrough of the child's legs. The back-support pouch 64, side panels 66, 68, and child seat portion 26 define the child compartment 28. A conventional child safety harness 76, having a rear end 78 (left end as viewed in FIG. 3) stitched to the back-support pouch 64 and a forward end (not shown) releasably connectable via a conventional safety buckle (not shown) to a forward part of the seat portion 26, maintains the child C in the child compartment 28. Preferably, the back-support pouch 64, side panels 66, 68, and seat portion 26 are of a suitable lightweight, flexible material such as a nylon material. It is to be understood that the back-support pouch 64, side panels 66, 68, and seat portion 26 may be formed of a single unitary sheet of material but are preferably formed from multiple sheets of material joined together as by stitching.

A kickstand, generally indicated at 80, preferably formed of aluminum tubing, is connected to the main frame member 44 via suitable hinges, each generally indicated at 82, for pivotal movement of the kickstand about an axis X. The kickstand 80 is generally U-shaped as viewed from the rear (see FIG. 1) and has two side portions 84 extending generally downward from the hinges 82 and a ground-engageable portion 86 extending between lower ends of the side portions. The kickstand 80 is moveable between a retracted position (FIG. 3) and a propping position (FIGS. 1 and 2). In the retracted position, the ground-engageable portion 86 (i.e., the lower portion) of the kickstand 80 is positioned generally adjacent the main frame member 44. In the propping position, the ground-engageable portion 86 of the kickstand 80 is positioned away from the main frame member 44 (i.e., to the left of the main frame member as viewed in FIG. 2) for engaging a generally horizontal surface, such as a floor or ground (not shown), to prop the child carrier 20 in a generally upright position on the surface when the child carrier is not being worn by the hiker H. Preferably, front feet 88 are positioned on lower ends of the leg portions 46, 48, and rear feet 90 are positioned on the ground-engageable portion 86 of the kickstand 80 for engagement with the surface.

Figure 7:
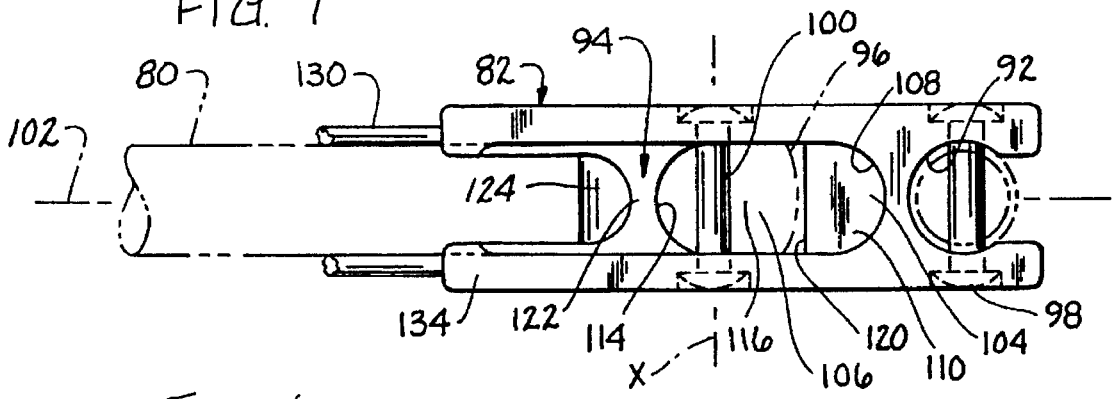
FIG. 7 is a bottom plan view of the hinge of FIG. 6.
Figure 6:
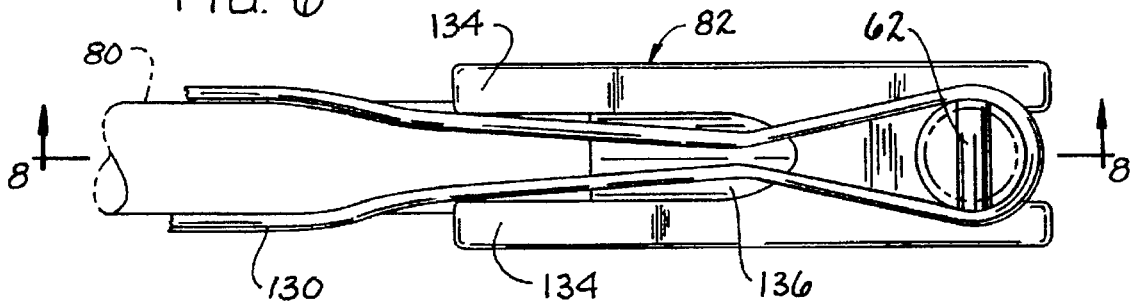
FIG. 6 is an enlarged top plan view of a hinge of the child carrier of FIGS. 1–3.

Referring now to FIGS. 4–8, each hinge 82 comprises a substantially rigid block having a generally cylindric-shaped slot 92 (FIG. 7) for receiving the upper region of one of the leg portions 46, 48 of the main frame member 44, and a socket, generally indicated at 94 (FIGS. 7 and 8), opening downwardly and rearwardly relative to the child carrier 20 for receiving an upper end region 96 of a corresponding one of the side portions 84 of the kickstand 80. The upper regions of the leg portions 46, 48 of the main frame member 44 constitute hinge mounting portions of the main frame member, and the hinges 82 are securely fastened thereto via suitable fasteners such as pin connections 60, 62 and rivets 98. The upper end regions 96 of the kickstand 80 are connected to the hinges 82 via pin-connectors 100 for pivotal movement of the kickstand about the axis X. As shown in FIGS. 7 and 9, each upper end region 96 of the kickstand 80 and corresponding hinge receiving portion of the main frame member 44 preferably lie in a plane (indicated by line 102) generally perpendicular to the axis X.

Figure 8:
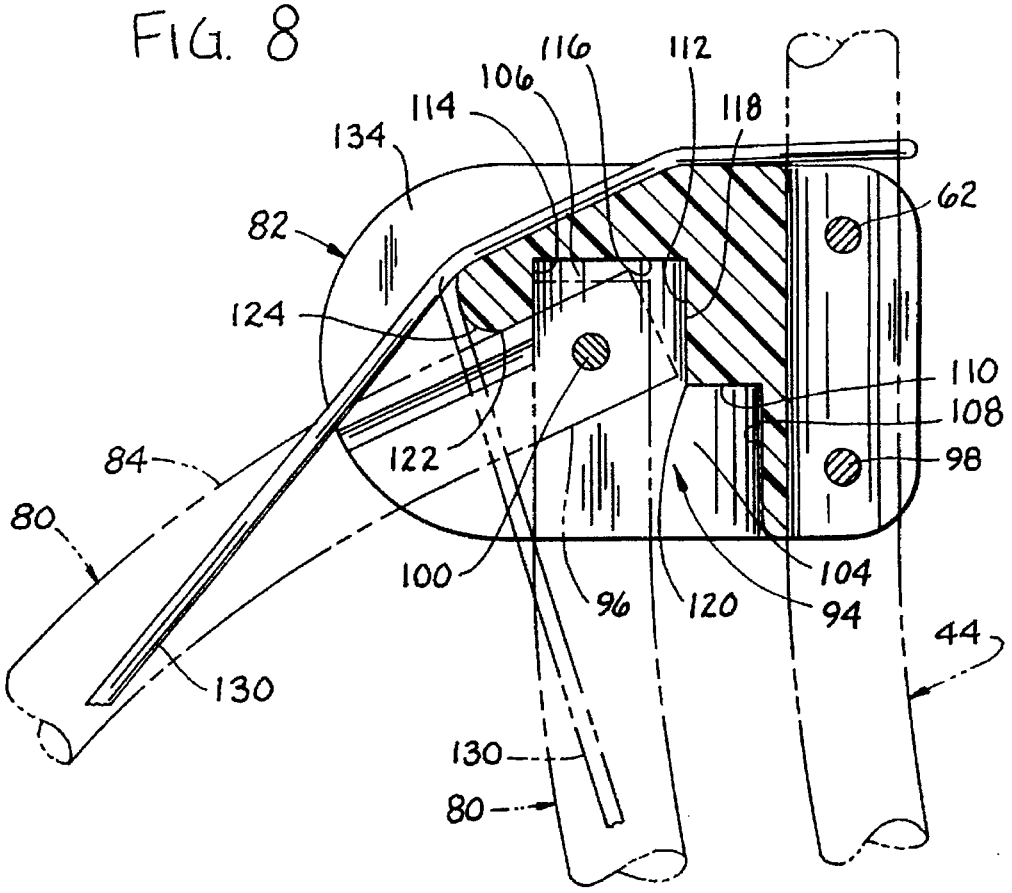
FIG. 8 is a cross-sectional view taken along the plane of line 8—8 of FIG. 6.
Figure 9:
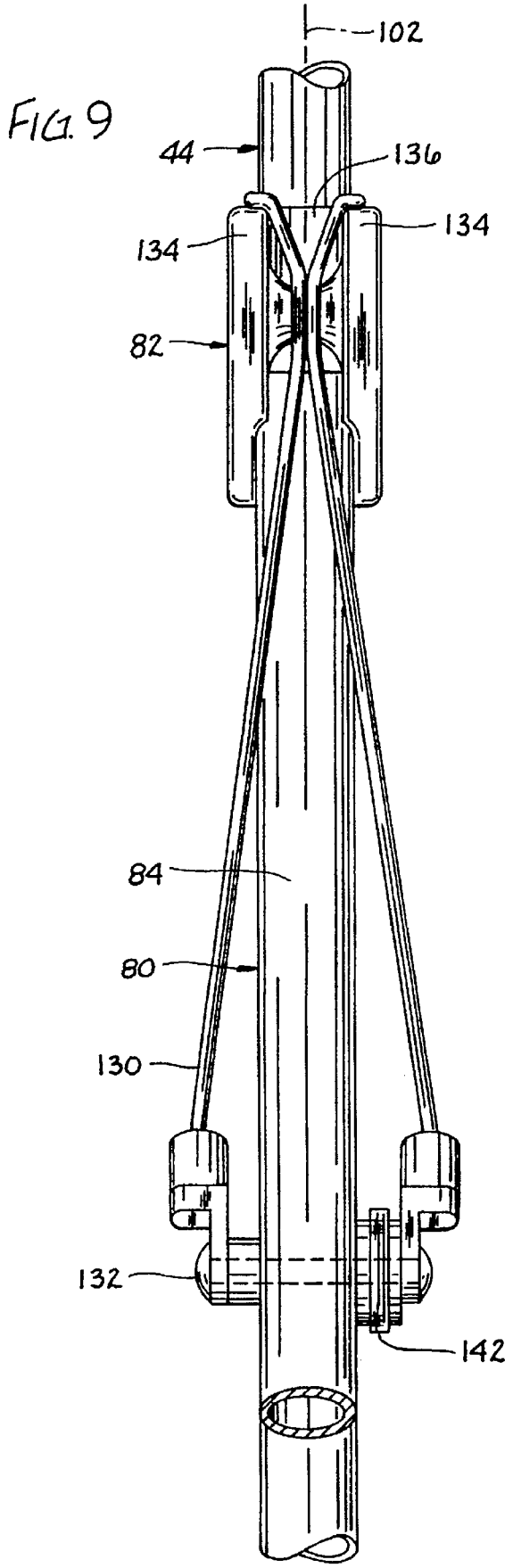
FIG. 9 is an enlarged fragmented rear elevational view of the kickstand, hinge, and main frame member of the child carrier of FIGS. 1–3.

As best illustrated in FIGS. 7 and 8, the socket 94 comprises adjacent front and rear recesses 104, 106. The front recess 104 is defined by a curved rearward-facing surface 108, and a flat downward-facing surface 110. The rear recess 106 extends farther into (i.e., farther up) the block of the hinge 82 than does the front recess 104. The rear recess 106 is defined by a flat rearward-facing surface 112, a curved forward-facing surface 114, and a flat downward-facing surface 116. The downward-facing surface 110 of the front recess 104 and the rearward-facing surface 112 of the rear recess 106 meet to form a step 118 (FIG. 8) having a corner edge 120. The pin-connector 100 extends laterally through the rear recess 106 (i.e., up and down as viewed in FIG. 7) so that the corresponding upper end region 96 of the kickstand 80 pivots within the rear recess 106.

The forward-facing surface 114 of the rear recess 106 constitutes a first shoulder engageable with the upper end region 96 of the kickstand 80. This shoulder acts as a stop when the kickstand 80 is pivoted to its retracted position for preventing pivoting of the kickstand to a position in which it engages the main frame member 44. In other words, the first shoulder prevents forward movement of the kickstand 80 relative to the main frame member 44 (i.e., counterclockwise rotation of the kickstand as viewed in FIG. 5) beyond the retracted position of the kickstand. In its retracted position, the upper end region 96 of the kickstand 80 is spaced a sufficient distance from the rearward-facing surface 108 of the front recess 104 to prevent a child's fingers from being pinched therebetween. Also, in its retracted position, the upper end region 96 of the kickstand 80 is spaced sufficiently close to the rearward-facing surface 112 of the rear recess 106 to prevent insertion of a child's fingers therebetween. Further, when the kickstand 80 is pivoted to its propping position (FIG. 4), the upper end of the kickstand is closely adjacent but slightly above the edge 120 of the step 118 to prevent a child's fingers from probing the upper regions of the rear recess 106.

The socket 94 is further defined by a slanted surface 122 rearward of and adjacent to the forward-facing surface 114 of the rear recess 106. The slanted surface 122 constitutes a second shoulder engageable by the upper end region 96 of the kickstand 80. The second shoulder 122 acts as a stop when the kickstand 80 is pivoted to its propping position for preventing rearward movement of the kickstand relative to the main frame member 44 (i.e., clockwise rotation of the kickstand as viewed in FIG. 4) beyond the propping position. A curved surface 124 is rearward of and adjacent the second shoulder 122. A child's finger placed adjacent the curved surface 124 will be rearwardly pushed (swept) by the kickstand 80 as the kickstand is pivoted to its propping position. Thus, the curved surface 124 also helps to avoid pinching of a child's finger.

Figure 5:
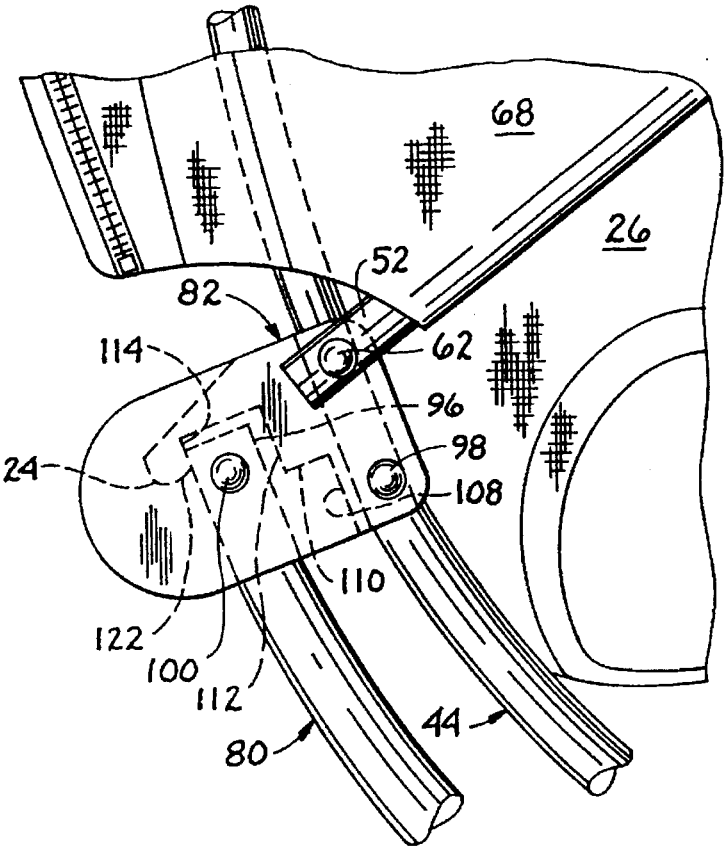
FIG. 5 is an enlarged fragmented side elevational view similar to FIG. 4 except with the kickstand in its retracted position.

Referring to FIGS. 2 and 5, each leg portion 46, 48 of the main frame member 44, and the corresponding hinge 82 and side portion 84 of the kickstand 80, are preferably shaped and configured for maintaining a minimum spacing between the main frame member 44 and kickstand when the kickstand is in its retracted position. Preferably, the minimum spacing between the main frame member 44 and kickstand 88 is at least approximately ¾. In other words, regardless of whether the kickstand 80 is retracted or in its propping position, every part of the kickstand is spaced at least approximately ¾" from every part of the main frame member 44 for preventing a child's fingers from being pinched between the kickstand and main frame member. Alternatively, the kickstand 80 engages the main frame member only at portions out of reach of a child C seated on the seat portion 26 in the child compartment 28 (e.g., only at lower portions of the kickstand and main frame member). A typical child in the child compartment may have arms 10" in length as measured from the child's arm pit to the child's wrist. The kickstand 80, hinges 82, and main frame member 44 are preferably shaped and configured for maintaining at least a minimum spacing (i.e., a spacing sufficient for preventing pinching of the hands and fingers of a child) between all portions of the kickstand and frame member which are within reach of such a child seated in the child compartment.

Two resilient, elastic cords (bungees), each designated 130, engage the main frame member 44 and the side portions 84 of the kickstand 80 to bias the kickstand toward its propping position. As shown in FIG. 9, each bungee 130 is connected at one end via a suitable pin-connector 132 to one of the side portions 84 of the kickstand 80, stretched over the respective hinge 82 around the main frame member 44, and connected at its other end to the pin-connector 132. Each hinge 82 further includes two laterally-spaced wings 134 (FIGS. 6 and 8) which define a bungee-receiving groove 136 for receiving intermediate portions of the bungee 130. The wings 134 impede a child from placing his/her fingers between the bungee 130 and hinge 82, and thereby prevent pinching of fingers therebetween. Also, the bungee 130 within the groove 136 obstructs access to the second shoulder 122 of the hinge 82 to further prevent pinching of a child's finger between the kickstand 80 and second shoulder.

Referring again to FIGS. 1–3, each shoulder strap 36 comprises a shoulder-engageable strap 138 and an adjustment strap 140 connected to the lower end of the shoulder-engageable strap. The adjustment strap 140 has a rear end-portion 142, a forward portion 144, and an intermediate portion 146 between the rear end-portion and the forward portion. The rear end-portion 142 is secured via pin-connector 132 (FIG. 9) to the kickstand 80. The intermediate portion 146 is threaded through and slidable in a strap receiving member 148 secured to one of the leg portions 46, 48 of the main frame member 44. A conventional buckle 150, securely fastened to the lower end of the shoulder-engageable strap 138, adjustably receives the forward portion 144 of the adjustment strap 140 for adjusting the effective length of the shoulder strap 36. Forwardly pulling off the forward portions 144 of the adjustment straps 140 (i.e., tensioning of the shoulder straps 36) sufficient to overcome the biasing force of the bungee 130 causes the kickstand 80 to move to its retracted position (FIG. 3). Preferably, when the hiker H is wearing the child carrier 20, the weight of the child C and child carrier sufficiently tensions the shoulder straps 36 to overcome the biasing force of the bungees 130. When the hiker H removes the child carrier 20 from his/her back, tension is released from the shoulder straps 36 and the biasing force of the bungees 130 causes the kickstand 80 to move to its propping position. Thus, the kickstand 80 automatically moves to its retracted position when the hiker H places the child carrier 20 on his/her back, and automatically moves to its propping position when the hiker H removes the child carrier.

In use, the kickstand 80 of the child carrier 20 is initially in its propping position and the feet 88, 90 of both the kickstand 80 and main frame member 44 engage the ground to prop the child carrier in an upright position. The child C is placed in the child compartment 28 and held therein by the child safety harness 76. The hiker H inserts his/her arms through the shoulder straps 36 and then stands to raise the child carrier 20. The weight of the child C and child carrier 20 causes sufficient tension in the shoulder straps 36 to overcome the biasing force of the bungees 130. The intermediate portions 146 of the adjustment straps 140 slide forward through the strap receiving members 148 of the main frame member 44 to rotate the kickstand 80 to its retracted position. Because the kickstand 80 automatically moves to its retracted position when the hiker H places the child carrier 20 on his/her back, the hiker does not need to remember to retract the kickstand. Also, because of the configuration of the hinges 82, kickstand 80, and main frame member 44, fingers and hands of the child C cannot be pinched between the kickstand and main frame member or between the kickstand and hinges as the kickstand is moved to its retracted position. When the child carrier 20 is removed from the back of the hiker H, tension in the shoulder straps 36 is removed and the biasing force of the bungees 130 causes the kickstand 80 to automatically move to its propping position.

Figure 10:
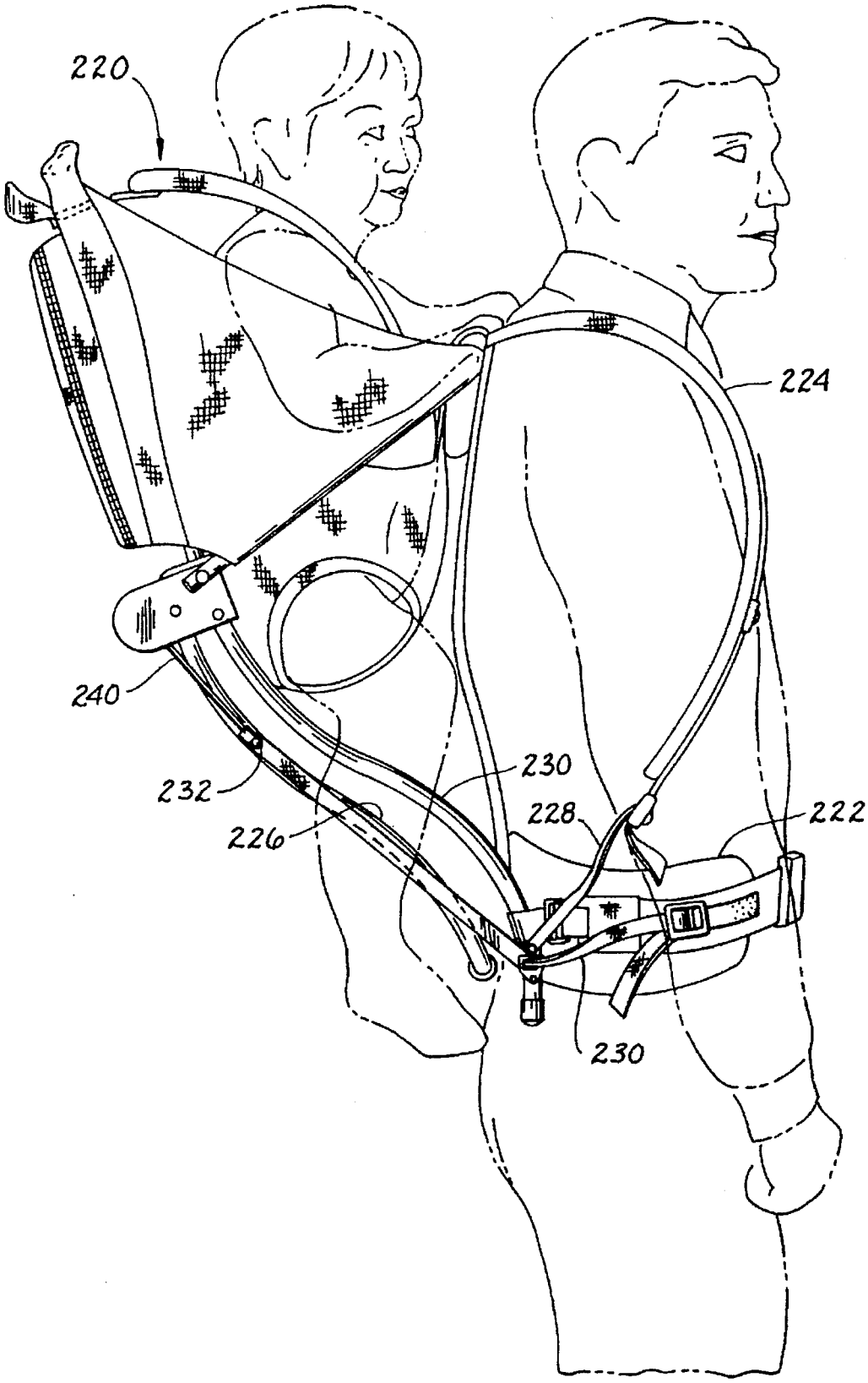
FIG. 10 is a side elevational view of another child carrier of the present invention showing an adjustable strap connecting a kickstand to a waist belt.

Referring now to FIG. 10, another child carrier of the present invention is indicated generally at 220. The child carrier 220 is identical to the child carrier 20 of FIGS. 1–9 except the waist belt 222, rather than the shoulder straps 224, is secured to the kickstand 226 to move the kickstand to its retracted position. The adjustment straps 228 of the shoulder straps 224 are secured to the main frame member 230. Two adjustment straps 230 (only one of which is shown in FIG. 10) of the waist belt 222 are secured at their rear end portions 232 to the kickstand 226. When the waist belt 222 is fastened around the waist of the hiker H, the tension of the belt is sufficient to overcome the biasing force of the bungees 240 and move the kickstand 226 to its retracted position. When the waist belt 222 is released, the biasing force of the bungees 240 moves the kickstand 226 to its propping position (not shown).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a generally rigid frame member operatively connected to and adjacent the rearward portion of the child carrier;

a kickstand having a ground-engageable portion;

a hinge operatively connecting the kickstand to the frame member for pivotal movement of the kickstand relative to the frame member between a retracted position in which the ground-engageable portion of the kickstand is positioned generally adjacent the frame member, and a propping position in which the ground-engageable portion of the kickstand is positioned away from the frame member for engaging a generally horizontal surface to prop the child carrier in a generally upright position on said generally horizontal surface when the child carrier is not being worn by the hiker;

at least one of the straps of the forward portion being operatively connected to the kickstand so that tensioning of said at least one of the straps causes the kickstand to move to its retracted position.

2. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a generally rigid frame member operatively connected to and adjacent the rearward portion of the child carrier;

a kickstand having a ground-engageable portion;

a hinge operatively connecting the kickstand to the frame member for pivotal movement of the kickstand relative to the frame member between a retracted position in which the ground-engageable portion of the kickstand is positioned generally adjacent the frame member, and a propping position in which the ground-engageable portion of the kickstand is positioned away from the frame member for engaging a generally horizontal surface to prop the child carrier in a generally upright position on said generally horizontal surface when the child carrier is not being worn by the hiker;

at least one resilient member applying a biasing force to the kickstand for urging the kickstand toward its propping position.

3. A child carrier as set forth in claim 2 wherein at least one of the straps of the forward portion is operatively connected to the kickstand so that tensioning of said at least one of the straps sufficient to overcome the biasing force of the resilient member causes the kickstand to move to its retracted position.

4. A child carrier as set forth in claim 3 wherein the straps of the forward portion comprise shoulder and waist straps, said at least one of the straps comprising at least one of the shoulder and waist straps.

5. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a generally rigid frame member operatively connected to and adjacent the rearward portion of the child carrier;

a kickstand having a ground-engageable portion;

a hinge operatively connecting the kickstand to the frame member for pivotal movement of the kickstand relative to the frame member about an axis X, the kickstand being pivotally moveable between a retracted position in which the ground-engageable portion of the kickstand is positioned generally adjacent the frame member, and a propping position in which the ground-engageable portion of the kickstand is positioned away from the frame member for engaging a generally horizontal surface to prop the child carrier in a generally upright position on said generally horizontal surface when the child carrier is not being worn by the hiker, the kickstand, hinge, and frame member being shaped and configured for maintaining at least a minimum spacing between all portions of the kickstand and frame member which are within reach of a child seated in the child compartment and having arms ten inches in length, said minimum spacing being sufficient for preventing hands and fingers of the child seated within the child compartment from being pinched between the kickstand and frame member during said pivotal movement of the kickstand relative to the frame member; and a resilient member applying a biasing force to the kickstand for urging the kickstand to its propping position.

6. A child carrier as set forth in claim 5 wherein at least one of the straps of the forward portion is operatively connected to the kickstand so that tensioning of said at least one of the straps sufficient to overcome the biasing force of the resilient member causes the kickstand to move to its retracted position.

7. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a generally rigid frame member operatively connected to and adjacent the rearward portion of the child carrier;

a kickstand having a ground-engageable portion;

a hinge operatively connecting the kickstand to the frame member for pivotal movement of the kickstand relative to the frame member about an axis X, the kickstand being pivotally moveable between a retracted position in which the ground-engageable portion of the kickstand is positioned generally adjacent the frame member, and a propping position in which the ground-engageable portion of the kickstand is positioned away from the frame member for engaging a generally horizontal surface to prop the child carrier in a generally upright position on said generally horizontal surface when the child carrier is not being worn by the hiker;

the kickstand, hinge, and frame member being shaped and configured for maintaining at least a minimum spacing between all portions of the kickstand and frame member which are within reach of a child seated in the child compartment and having arms ten inches in length, said minimum spacing being sufficient for preventing hands and fingers of the child seated within the child compartment from being pinched between the kickstand and frame member during said pivotal movement of the kickstand relative to the frame member, at least one of the straps of the forward portion being operatively connected to the kickstand so that tensioning of said at least one of the straps causes the kickstand to move to its retracted position.

8. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a generally rigid frame member operatively connected to and adjacent the rearward portion of the child carrier;

a kickstand having a ground-engageable portion and an end portion;

a hinge comprising a generally rigid block fixed to the frame member, said rigid block defining a socket, said end portion of the kickstand being received within the socket and pivotally connected to the rigid block for pivotal movement of the kickstand relative to the frame member between a retracted position in which the ground-engageable portion of the kickstand is positioned generally adjacent the frame member, and a propping position in which the ground-engageable portion of the kickstand is positioned away from the frame member for engaging a generally horizontal surface to prop the child carrier in a generally upright position on said generally horizontal surface when the child carrier is not being worn by the hiker;

said rigid block having a shoulder within the socket and engageable with said end portion of the kickstand when the kickstand is in its retracted position, the shoulder acting as a stop when the kickstand is pivoted from its propping position to its retracted position for preventing pivoting of the kickstand to a position in which it engages the frame member; and a resilient member applying a biasing force to the kickstand for urging the kickstand to its propping position.

9. A child carrier as set forth in claim 8 wherein at least one of the straps of the forward portion is operatively connected to the kickstand so that tensioning of said at least one of the straps sufficient to overcome the biasing force of the resilient member causes the kickstand to move to its retracted position.

10. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a generally rigid frame member operatively connected to and adjacent the rearward portion of the child carrier;

a kickstand having a ground-engageable portion and an end portion;

a hinge comprising a generally rigid block fixed to the frame member, said rigid block defining a socket, said end portion of the kickstand being received within the socket and pivotally connected to the rigid block for pivotal movement of the kickstand relative to the frame member between a retracted position in which the ground-engageable portion of the kickstand is positioned generally adjacent the frame member, and a propping position in which the ground-engageable portion of the kickstand is positioned away from the frame member for engaging a generally horizontal surface to prop the child carrier in a generally upright position on said generally horizontal surface when the child carrier is not being worn by the hiker;

said rigid block having a shoulder within the socket and engageable with said end portion of the kickstand when the kickstand is in its retracted position, the shoulder acting as a stop when the kickstand is pivoted from its propping position to its retracted position for preventing pivoting of the kickstand to a position in which it engages the frame member;

at least one of the straps of the forward portion being operatively connected to the kickstand so that tensioning of said at least one of the straps causes the kickstand to move to its retracted position.

* * * * *